US008864631B1

(12) United States Patent
Stearns et al.

(10) Patent No.: US 8,864,631 B1
(45) Date of Patent: Oct. 21, 2014

(54) EXERCISE METHODS AND APPARATUS

(76) Inventors: Kenneth W Stearns, Houston, TX (US); Joseph D. Maresh, West Linn, OR (US)

( * ) Notice: Subject to any disclaimer, the term of this patent is extended or adjusted under 35 U.S.C. 154(b) by 385 days.

(21) Appl. No.: 13/135,680

(22) Filed: Jul. 11, 2011

Related U.S. Application Data

(63) Continuation-in-part of application No. 12/902,136, filed on Oct. 11, 2010, now Pat. No. 8,147,384, which is a continuation of application No. 12/389,370, filed on Feb. 19, 2009, now Pat. No. 7,811,207.

(60) Provisional application No. 61/066,287, filed on Feb. 19, 2008, provisional application No. 61/399,312, filed on Jul. 10, 2010.

(51) Int. Cl.

| | |
|---|---|
| ***A63B 22/04*** | (2006.01) |
| ***A63B 22/00*** | (2006.01) |
| ***A63B 21/00*** | (2006.01) |
| ***A63B 21/22*** | (2006.01) |

(52) U.S. Cl.
USPC ..... 482/52; 482/51; 482/63

(58) Field of Classification Search
CPC ..... A63B 21/225; B65H 23/044; F16H 7/12
USPC ..... 482/1–9, 51–53, 57–65, 92, 110–139, 482/148, 900–903, 908–909; 73/862.194, 73/862.391, 862.451, 862.471, 862.472, 73/862.474; 271/265.01
See application file for complete search history.

(56) References Cited

U.S. PATENT DOCUMENTS

| | | | | | |
|---|---|---|---|---|---|
| 4,141,245 | A * | 2/1979 | Brandstetter | 73/862.46 |
| 4,221,275 | A * | 9/1980 | Pennebaker et al. | 180/206.3 |
| 4,909,086 | A * | 3/1990 | Kaneko et al. | 73/862.194 |
| 4,934,692 | A * | 6/1990 | Owens | 482/63 |
| 5,027,303 | A * | 6/1991 | Witte | 702/44 |
| 5,167,159 | A * | 12/1992 | Lucking | 73/862.451 |
| 5,305,648 | A * | 4/1994 | Diekhans et al. | 73/862.191 |
| 6,206,804 | B1 * | 3/2001 | Maresh | 482/52 |
| 6,612,969 | B2 * | 9/2003 | Eschenbach | 482/51 |
| 2005/0181911 | A1 * | 8/2005 | Porth | 482/52 |
| 2009/0013804 | A1 * | 1/2009 | Hanoun | 73/862.474 |
| 2010/0248899 | A1 * | 9/2010 | Bedell et al. | 482/4 |
| 2010/0317494 | A1 * | 12/2010 | Wang | 482/110 |
| 2012/0115685 | A1 * | 5/2012 | Bedell et al. | 482/52 |

* cited by examiner

*Primary Examiner* — Stephen Crow
*Assistant Examiner* — Joshua Lee
(74) *Attorney, Agent, or Firm* — Nick A Nichols, Jr.

(57) ABSTRACT

An exercise apparatus links rotation of a crank to generally elliptical motion of a foot supporting member. A foot supporting linkage is movably connected between a rocker and a crank in such a manner that the foot supporting member moves through paths of motion which are fixed, adjustable or variable.

7 Claims, 12 Drawing Sheets

EXERCISE METHODS AND APPARATUS

CROSS-REFERENCE TO RELATED APPLICATION

This application is a continuation-in-part of U.S. patent application Ser. No. 12/902,136, filed Oct. 11, 2010 now U.S. Pat. No. 8,147,384, which is a continuation of U.S. patent application Ser. No. 12/389,370, filed Feb. 19, 2009, now U.S. Pat. No. 7,811,207, which claim the benefit of U.S. Provisional Application Ser. No. 61/066,287, filed Feb. 19, 2008. This application also claims the benefit of U.S. Provision Application Ser. No. 61/399,312, filed Jul. 10, 2010, which applications are incorporated herein by reference.

BACKGROUND OF THE INVENTION

The present invention relates to fitness machines, and in particular to fitness machines which constrain the user's foot and/or arm to travel along a variable or fixed foot path.

Exercise equipment has been designed to facilitate a variety of exercise motions (including treadmills for walking or running in place; stepper machines for climbing in place; bicycle machines for pedaling in place; and other machines for skating and/or striding in place. Yet another type of exercise equipment has been designed to facilitate relatively more complicated exercise motions and/or to better simulate real life activity. Such equipment converts a relatively simple motion, such as circular, into a relatively more complex motion, such as elliptical. Despite various advances in the elliptical exercise category, there remains room for improvement.

SUMMARY OF THE INVENTION

The present invention may be seen to provide a novel linkage assembly and corresponding exercise apparatus suitable for linking circular motion to relatively more complex, generally elliptical motion. Left and right cranks are rotatably mounted on a frame. A foot supporting linkage is movably connected between a rocker and the left and right cranks in such a manner that the foot supporting member moves through paths of motion which are fixed, adjustable or variable.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

Figure 1:
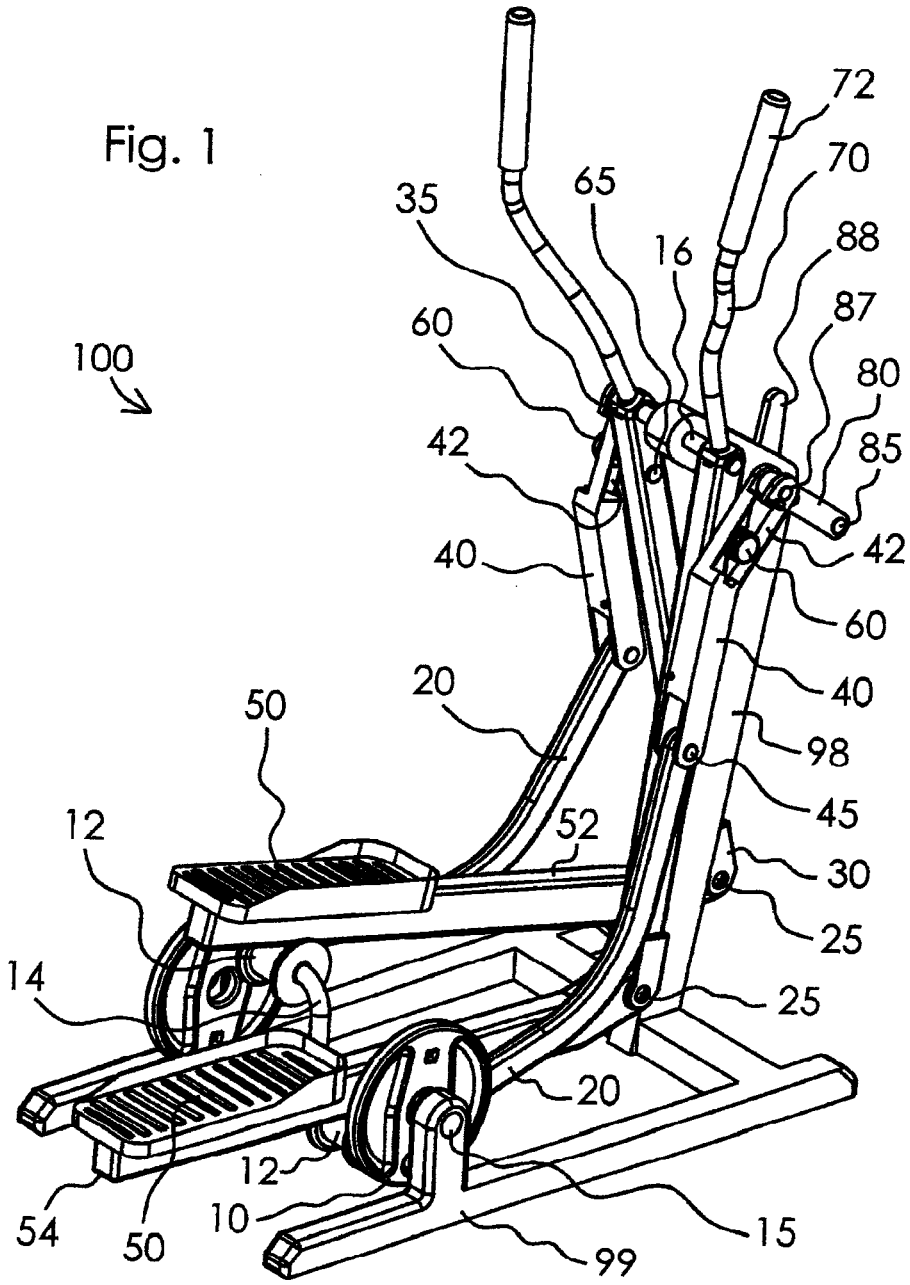
FIG. 1 is a perspective view taken from the rear of a first embodiment of the exercise apparatus of the invention.

The present invention provides elliptical motion exercise machines which link rotation of left and right cranks to generally elliptical motion of respective left and right foot supports. The term "elliptical motion" is intended in a broad sense to describe a closed path of motion having a relatively longer major axis and a relatively shorter minor axis. In general, the present invention may be said to use displacement of the cranks to move the foot supports in a direction coincidental with one axis of the elliptical path, and displacement of crank driven members to move the foot supports in a direction coincidental with the other axis. A general characteristic of the present invention is that the crank diameter determines the length of one axis, but does not determine the length of the other axis. As a result of this feature, a person's feet may pass through a space between the cranks while nonetheless traveling through a generally elliptical path having a desirable aspect ratio, and the machines that embody this technology may be made relatively more compact, as well. The embodiments shown and/or described herein are generally symmetrical about a vertical plane extending lengthwise through a floor-engaging base (perpendicular to the transverse ends thereof). In general, the "right-hand" components are one hundred and eighty degrees out of phase relative to the "left-hand" components. However, like reference numerals are used to designate both the "right-hand" and "left-hand" parts, and when reference is made to one or more parts on only one side of an apparatus, it is to be understood that corresponding part(s) are disposed on the opposite side of the apparatus. Also, to the extent that reference is made to forward or rearward portions of an apparatus, it is to be understood that a person can typically exercise on such apparatus while facing in either direction relative to the linkage assembly.

Figure 2:
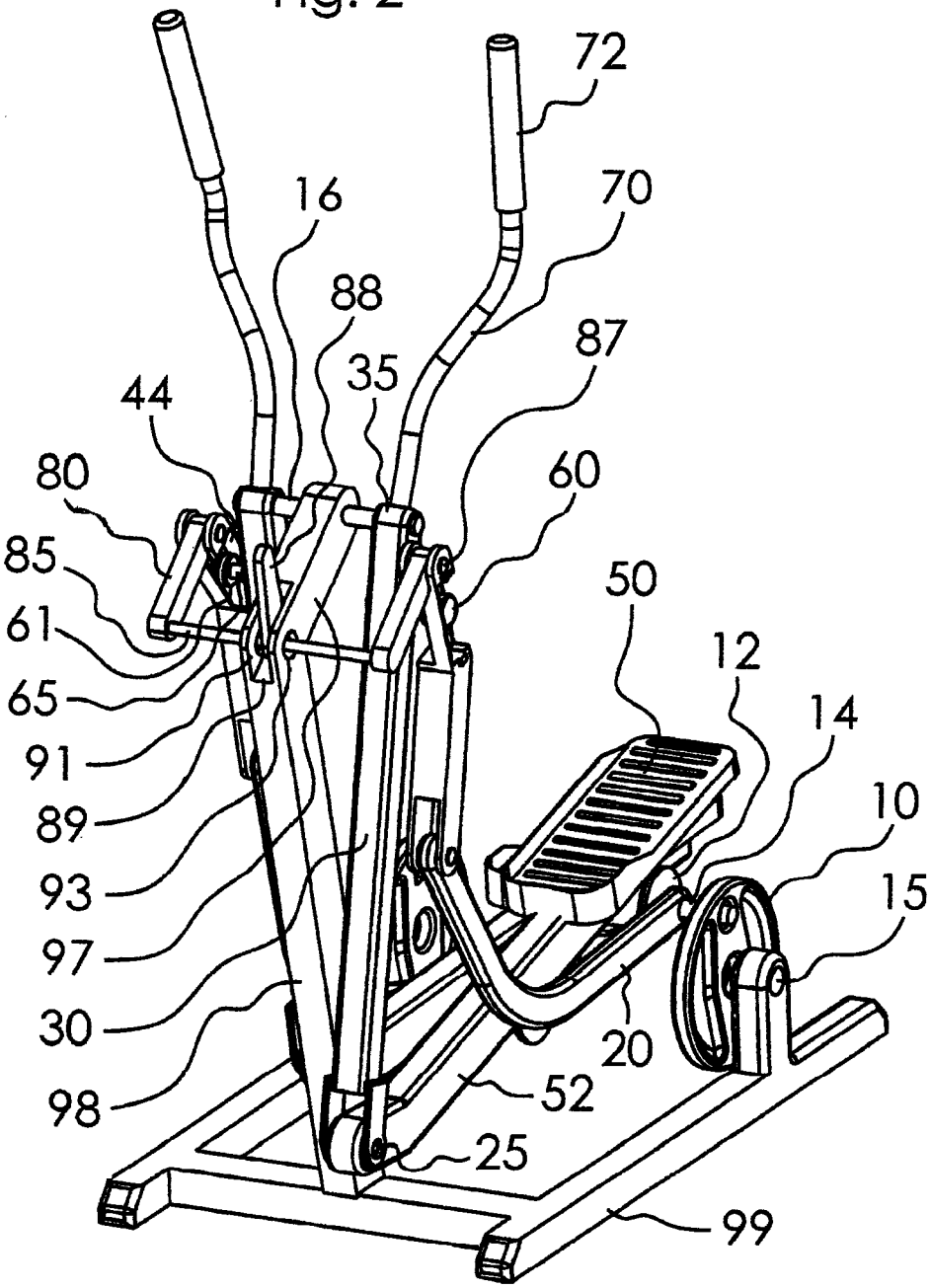
FIG. 2 is a perspective view taken from the front of the exercise apparatus of FIG. 1.

Referring first to FIGS. 1 and 2, a first embodiment of the exercise apparatus of the invention is generally identified by the reference numeral 100. The apparatus 100 includes a frame 99 that is designed to rest upon a floor surface. A stanchion 98 extends upward from a forward end of the base 99. The stanchion 98 includes an upper segment 97 that extends angularly upward toward a user positioned on the apparatus 100.

Left and right crank disks 10 are rotatably mounted on respective sides of the frame 99 at respective journals 15 proximate the rear end of the frame 99. A crank 14 is interconnected between the crank disks 10. Left and right rollers 12 are rotatably mounted on the crank 14 for orbital movement about the crank disks 10 axis and are concentric with the distal ends of drawbars 20 rotatably connected to the crank 14. Both crank disks 10 are shown in the form of disks, but crank arms may be used in the alternative. An advantage of using a crank disk is that it may be more readily connected to any of various known inertia altering devices, including, for example, a motor, a "stepped up" flywheel, an adjustable braking mechanism, or various combinations thereof.

Left and right drawbars 20 are pivotally connected to the crank 14 at rearward distal ends thereof. Each drawbar 20 includes an extension or lever member 40 that is pivotally connected to a forward distal end of the drawbar 20 at pin 45. The upper distal end of extension member 40 is formed by laterally offset oppositely facing race members 42 and 44 pivotally connected to a lever arm 80 at pin 87. A concentric pair of rollers 60 and 61 rotatably mounted about a shaft 65 connected to a rocker link 30 is received between the race members 42 and 44. The rollers 60 and 61 engage the race members 42 and 44, respectively, in a manner which allows constant contact. Alternate designs may be utilized, such as non-concentric rollers, or mounting the rollers on pivot yoke members or the like.

Left and right rocker links 30 are pivotally mounted on respective sides of the stanchion 98. Each rocker link 30 extends generally downward from a rocker hub 35 that is pivotally connected to a transverse rocker shaft 16 fixed proximate the upper end of the stanchion 98. Handle bar members 70 are pivotally mounted on respective sides of the stanchion 98. Each handle bar member 70 extends generally upward from the rocker hub 35. The upper end of each handle bar member 70 includes a hand grip 72.

Referring again to FIG. 2, the stanchion 98 includes a recessed channel 89 at the juncture with the upper angled segment 97. The channel 89 is defined by upstanding stanchion flange members 91 that include aligned holes 93 extending therethrough. A transverse shaft 85 extends through the holes 93. The lower end of a handle 88 extends into the channel 89 and is rigidly fixed to the shaft 85. Left and right lever links 80 are fixedly secured to the transverse shaft 85 at one end and pivotally connected at the opposite ends thereof to race members 42 and 44 at pin 87.

Referring again to FIG. 1, left and right foot members 52 have forward ends that are pivotally connected to the lower ends of respective rocker links 30 and rearward portions that are supported on respective rollers 12 rotatably mounted on the crank 14. The rollers 12 are in rolling contact with the underside of the rearward portions of the foot members 52. Left and right foot supports 50 are mounted on the rearward portions of respective foot member 52.

In the embodiment of the apparatus 100 shown in FIGS. 1 and 2, the handle 88 may be adjusted by the user to adjust the stride foot path. In general, pulling the handle 88 back toward the user rotates the shaft 85 which in turn rotates the lever links 80 forcing the race members 42 and 44 to move downward relative to the rollers 60 which are fixedly secured to the rocker links 30 and thereby shortening the longitudinal component of the foot path P1 and the arm path Q1 illustrated in FIG. 3. The relative position of the rollers 60 to the race formed by the race members 42 and 44, as defined by the distance between lever link pin 87 and roller shaft 65, determines the longitudinal component of the foot path. During use of the apparatus 100, the rollers 60 move along a linear reciprocating path within the race defined by the race members 42 and 44. A longer linear path results in a longer longitudinal component of the foot path.

Figure 3:
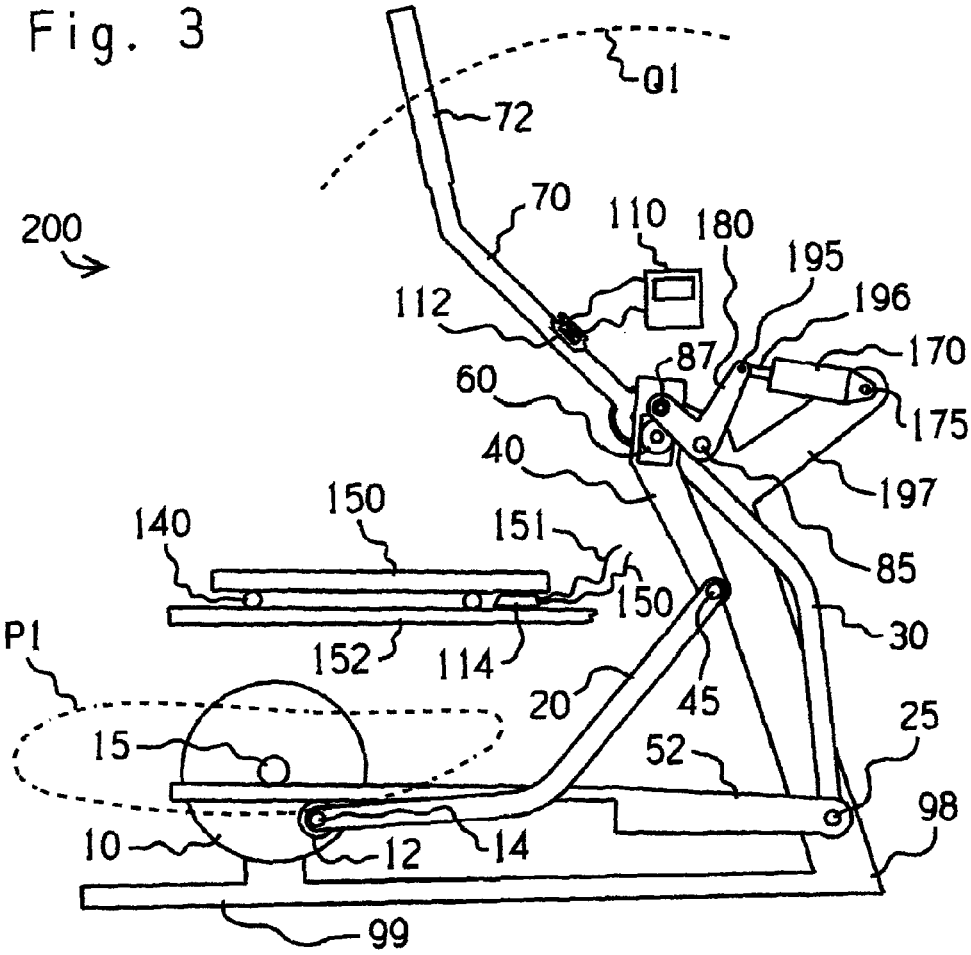
FIG. 3 is a side view of a second embodiment of the exercise apparatus of the invention.
Figure 4:
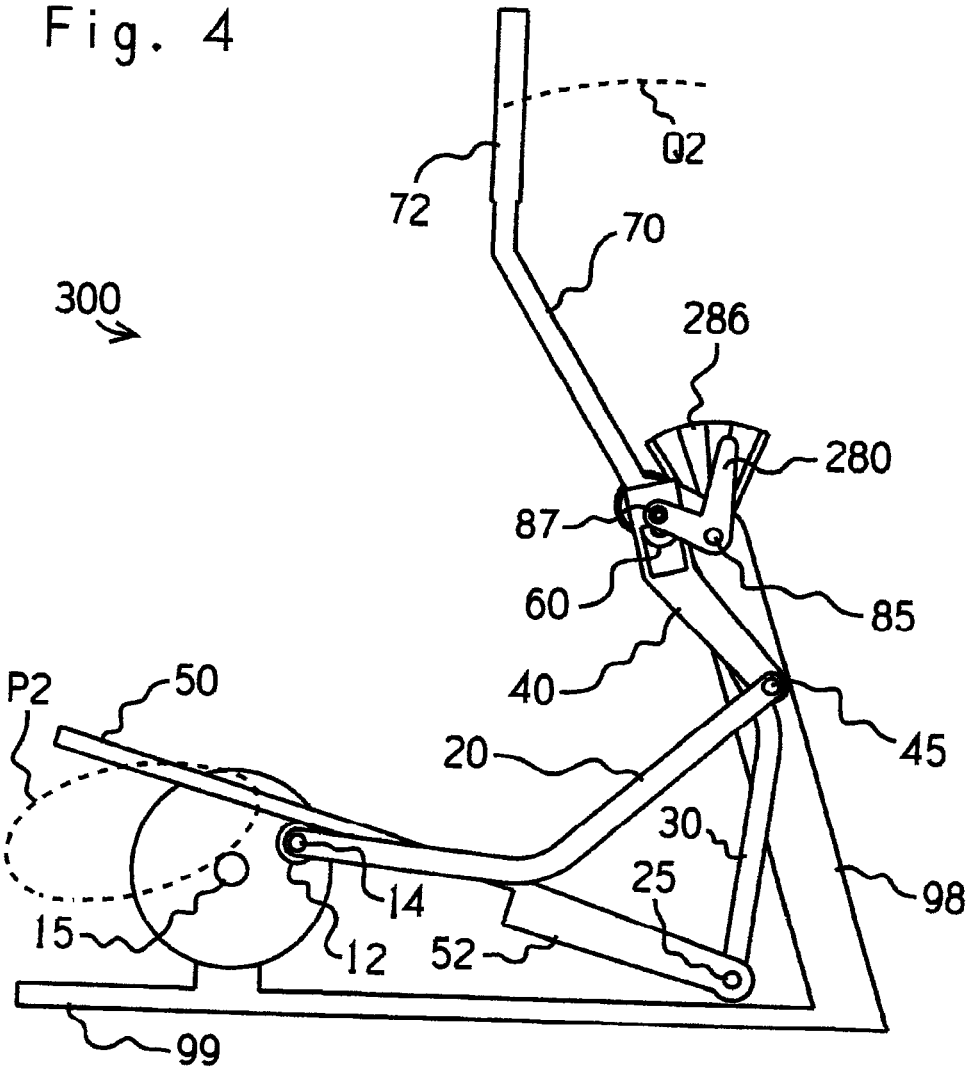
FIG. 4 is a side view of a third embodiment of the exercise apparatus of the invention.
Figure 5:
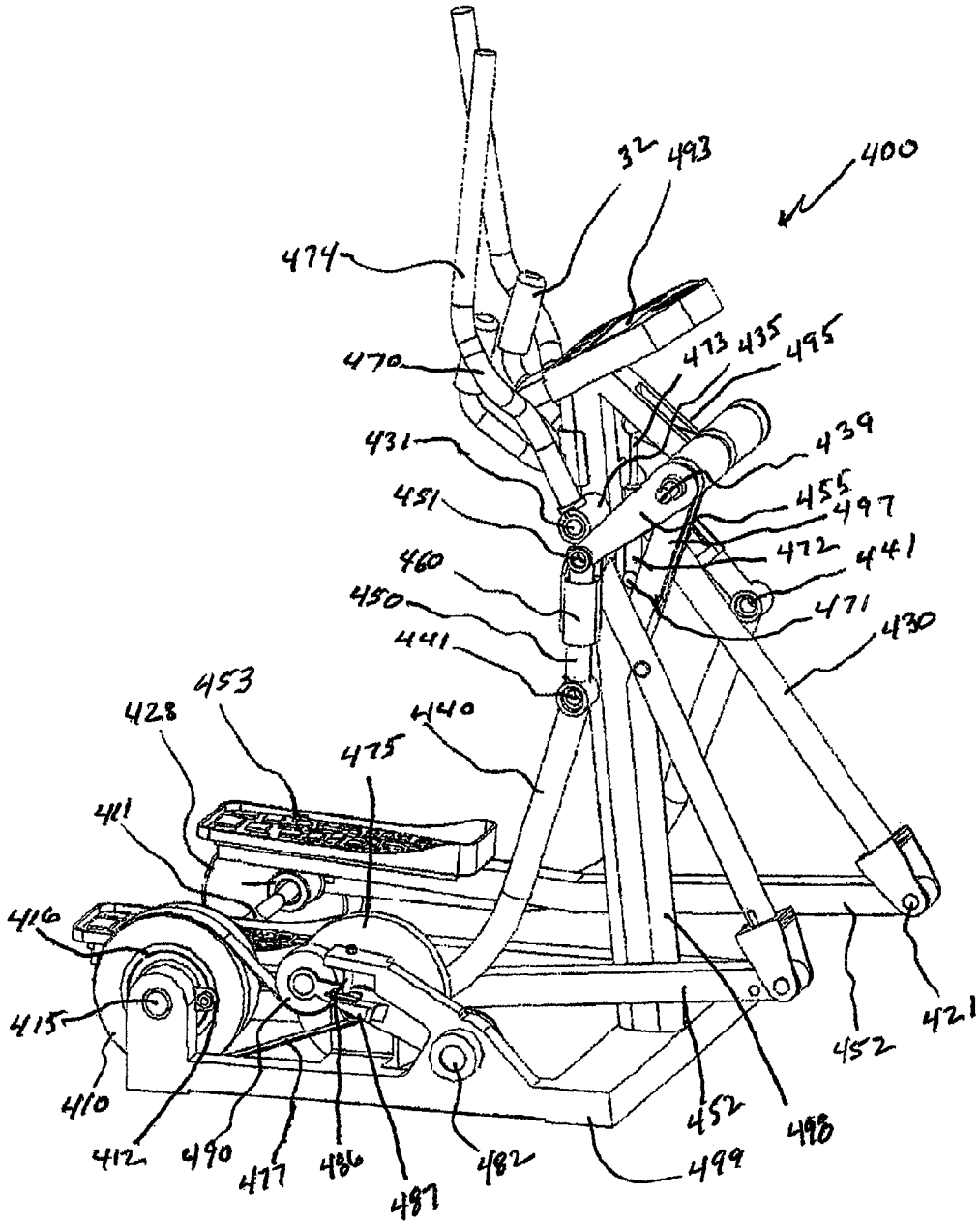
FIG. 5 is a perspective view of a fourth embodiment of the exercise apparatus of the invention.
Figure 6:
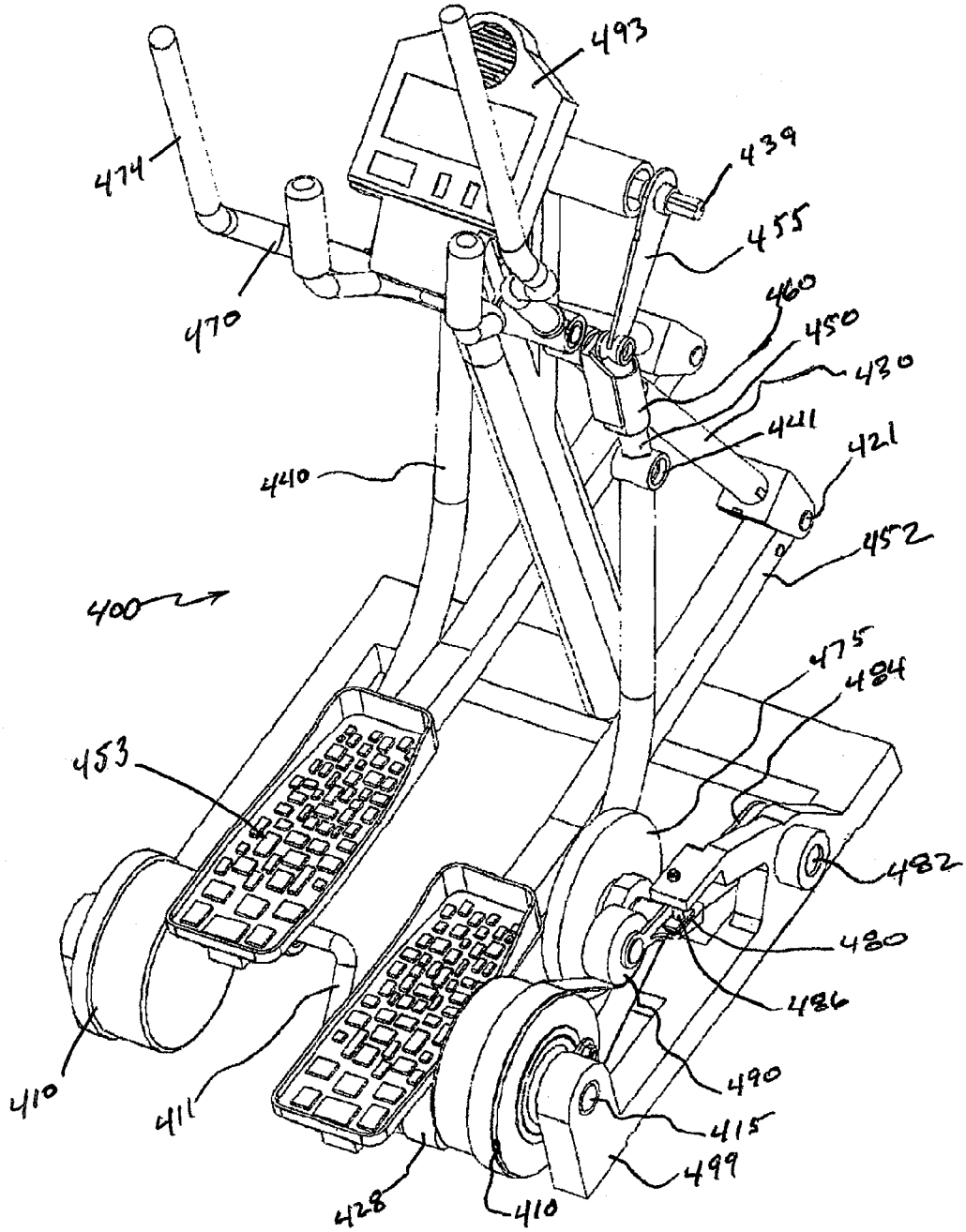
FIG. 6 is perspective view of the exercise apparatus of FIG. 5 taken from the rear of the exercise apparatus.

Adjusting the foot and arm paths may be better understood by referring first to FIG. 3, where it will be observed that the pivot axis defined by the pin 87 is relatively far from the pivot axis defined by the roller shaft 65 and thereby resulting in a relatively large foot path P1 and arm path Q1. In FIG. 4, the pivot axis defined by the pin 87 is relatively close to the pivot axis defined by the roller shaft 65 resulting in a relatively smaller foot path P2 and arm path Q2.

Referring again to FIG. 3, a second embodiment of the exercise apparatus of the invention generally identified by the reference numeral 200 is shown. The apparatus 200 is substantially the same as the apparatus 100 described above with the exception that the apparatus 200 includes an actuator 170 and a strain sensor 112. The actuator 170 is pivotally connected at pin 175 to the distal end of a support member 197 extending angularly upward and away from a user position on the exercise apparatus 200. The actuator may be a piston or the like having the distal end of a piston rod 196 pivotally connected to a link member 180. The opposite end of the link member 180 is fixedly secured to the shaft 85.

The apparatus 200 may produce a variable foot path in response to force exerted by the user. The sensor 112 may be attached to the handle bar 70. Output signals from the sensor 112 may be transmitted to a console/computer operatively connected to the actuator 170. The sensor 112 generates an output signal proportional to the magnitude of the force exerted by the user on the handle bars 70. The output signal of the sensor 112 controls the movement of the piston rod 196 of the actuator 170 thereby adjusting the relative position of the pivot axis of pin 87 and roller shaft 65. For example, exerting greater force by the user on the handle bars 70 may result in an output signal from the sensor 112 to effect a retraction of the piston rod 196 which in turn moves the pivot axis of pin 87 relatively farther from the pivot axis of the roller shaft 65 thereby resulting in a longer stride foot path. Alternatively, the force exertion sensor, for example, sensor 114 may be located between the foot supports 50 and the foot member 52, thereby providing a sensor 114 output signal proportional to the magnitude of the user applied force in a longitudinal direction relative to the foot member 52.

Referring now to FIG. 4, a third embodiment of the exercise apparatus of the invention generally identified by the reference numeral 300 is shown. The apparatus 300 is substantially the same as the apparatus 100 described above with the exception that the apparatus 300 includes a manual adjusting lever 280 that may be manually locked against a frame plate 286. The frame plate 286 permits the user to lock the lever at intermediate points to effect a change in the foot and arm paths P2 and Q2.

A fourth embodiment of an exercise apparatus generally identified by the reference numeral 400 is shown in FIGS. 5-11. The apparatus 400 includes a frame 499 that is designed to rest upon a floor surface. A stanchion 498 extends upward from a forward end of the frame 499. The stanchion 498 includes a frame member 497 that extends angularly upward from an intermediate point on the stanchion 498 away from a user positioned on the apparatus 400. A frame member 495 extends angularly downward from proximate the upper distal end of the stanchion 498 away from a user positioned on the apparatus 400. The frame members 495 and 497 are joined at the distal ends thereof.

Left and right crank disks 410 are rotatably mounted on respective sides of the machine frame 499 at respective journals 415 proximate the rear end of the frame 499. A crank 411 is interconnected between the crank disks 410. Left and right crank rollers 428 are rotatably mounted on the crank 411 for orbital movement about the crank disks 410 axis and are concentric with the distal ends of drawbars 440 rotatably connected to the crank 411. Crank disks 410 are shown in the drawings in the form of disks, but crank arms may be used in the alternative.

A rearward distal end of drawbar 440 is rotatably connected to crank 411 and a forward distal end of drawbar 440 is rotatably connected to a lower distal end of a drawbar rocker 450 at bearing 441. An upper distal end of the drawbar rocker 450 is rotatably connected to a lever arm 455 at bearing 451. The lever arm 455 is rigidly connected to a transverse lever shaft 439. The shaft 439 extends through a hole formed at the juncture of the angular frame members 495 and 497 and is rotatably supported by the stanchion 498. The drawbar rocker 450 concentrically telescopes relative to a sleeve coupler 460 mounted about the drawbar rocker 450. The sleeve coupler 460 is pivotally secured to rocker link 430 at pin 432 extending through rocker bearing 433.

Left and right rocker links 430 are pivotally mounted on respective sides of the stanchion 498. Each rocker link 430 extends generally downward from a rocker hub 435 that is pivotally connected to a transverse rocker shaft 431 fixed proximate the upper end of the stanchion 498. Handle bar members 470 are pivotally mounted on respective sides of the stanchion 498. Each handle bar member 470 extends generally upward from the rocker hub 435. The upper end of each handle bar member 470 includes a hand grip 474.

Referring again to FIG. 5, left and right foot members 452 have forward ends that are pivotally connected to the lower ends of respective rocker links 430 at bearing 421 and rearward portions that are supported on respective rollers 428 rotatably mounted on the crank 411. The rollers 428 are in rolling contact with the underside of the rearward portions of the foot members 452. Left and right foot platforms 453 are mounted on the rearward portions of a respective foot member 452.

An actuator 472 is pivotally connected to the stanchion 498 at pin 471. The actuator 472 may be a piston or the like having the distal end of a piston rod 473 pivotally connected to a link member 468. The opposite end of the link member 468 is fixedly secured to the lever shaft 439. The magnitude of extension or retraction of piston rod 473 effects the arm and foot range of motion of a user positioned on the apparatus 400. A first pivot axis is defined by the bearing 451 connecting the drawbar rocker 450 to the lever arm 455. A second pivot axis is defined by the rocker shaft 431 connecting the rocker link 430 to the stanchion 498. Actuation of the actuator 472 adjusts the position of the first pivot axis defined by the bearing 451 relative to the second pivot axis defined by the rocker shaft 431. Generally, as the piston rod 473 of the actuator 472 retracts, the distance between the first pivot axis and the second pivot axis increases, and the arm and foot range of motion of the user decreases. Conversely, as the piston rod 473 extends, the arm and foot range of motion of the user increases as the distance between the first pivot axis and the second pivot axis increases.

Figure 7:
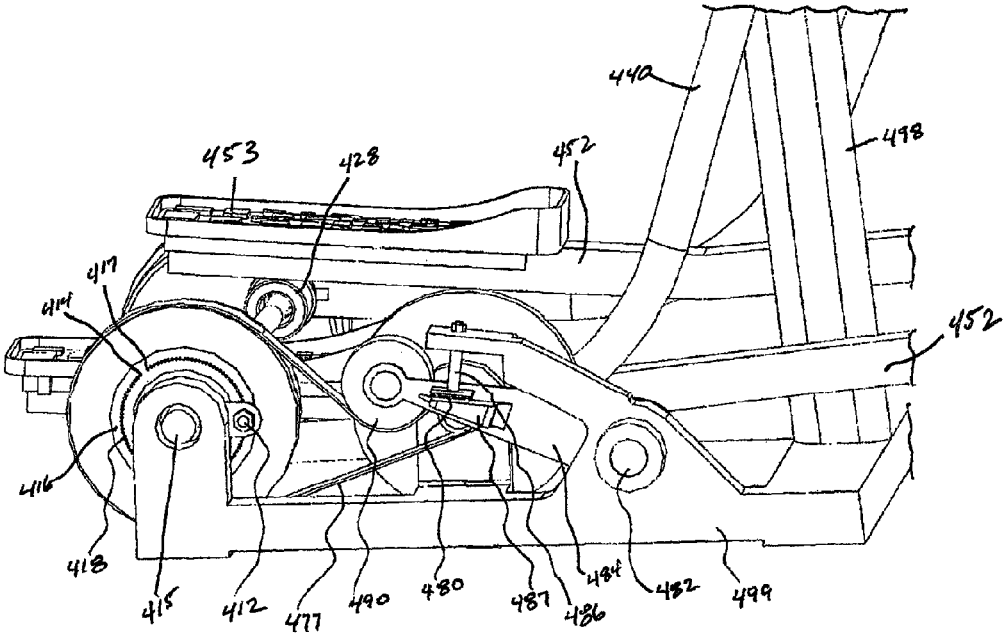
FIG. 7 is a fragmentary perspective view of the exercise apparatus of FIG. 5.
Figure 8:
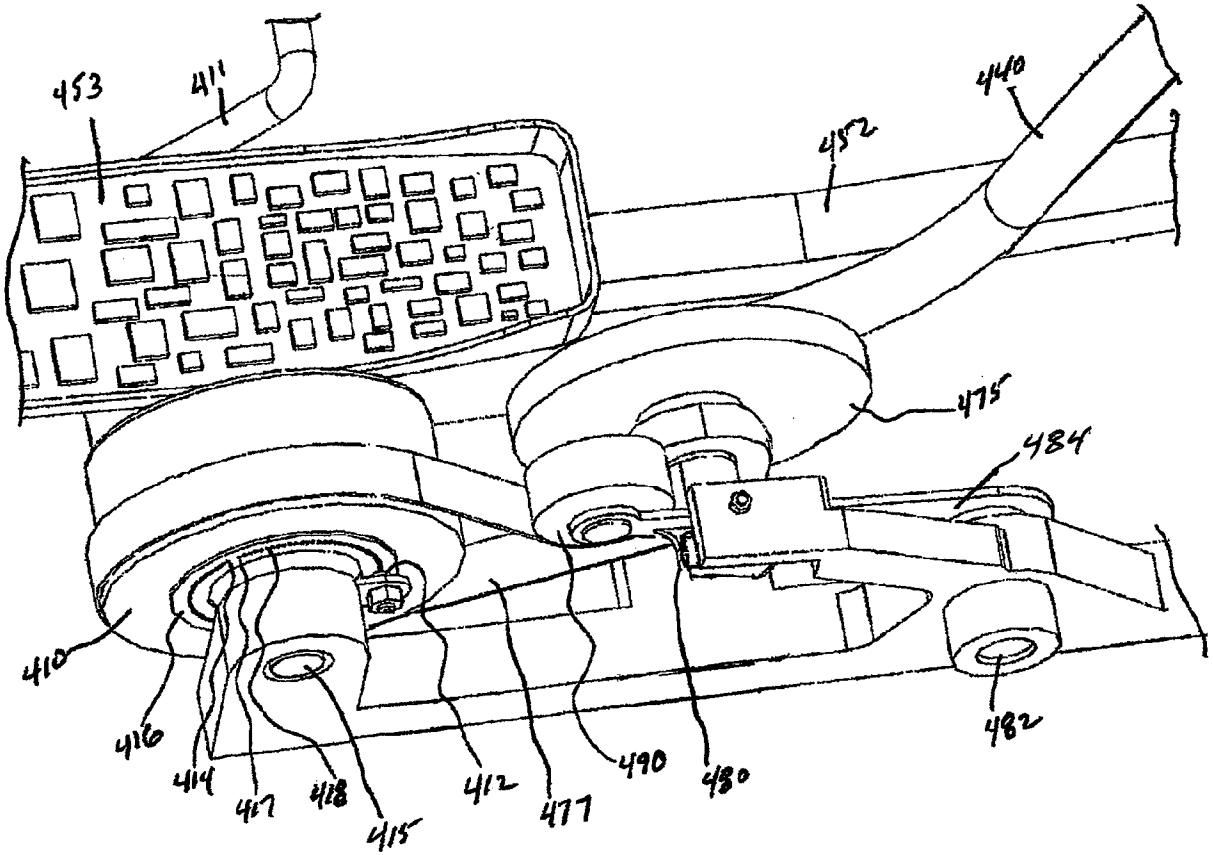
FIG. 8 is a fragmentary perspective view of the exercise apparatus of FIG. 5 taken from above the exercise apparatus.
Figure 9:
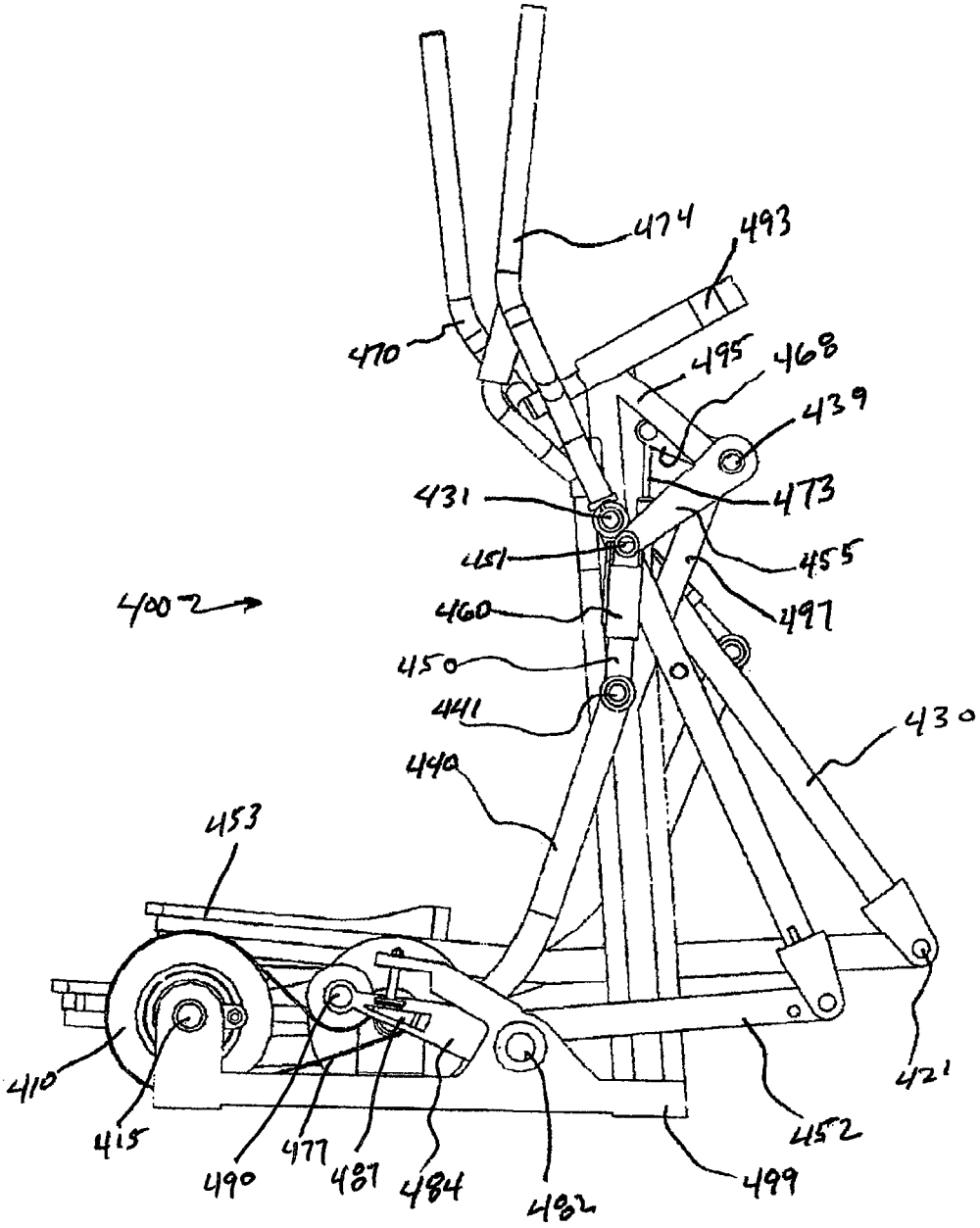
FIG. 9 is a side view of the exercise apparatus of FIG. 5.
Figure 10:
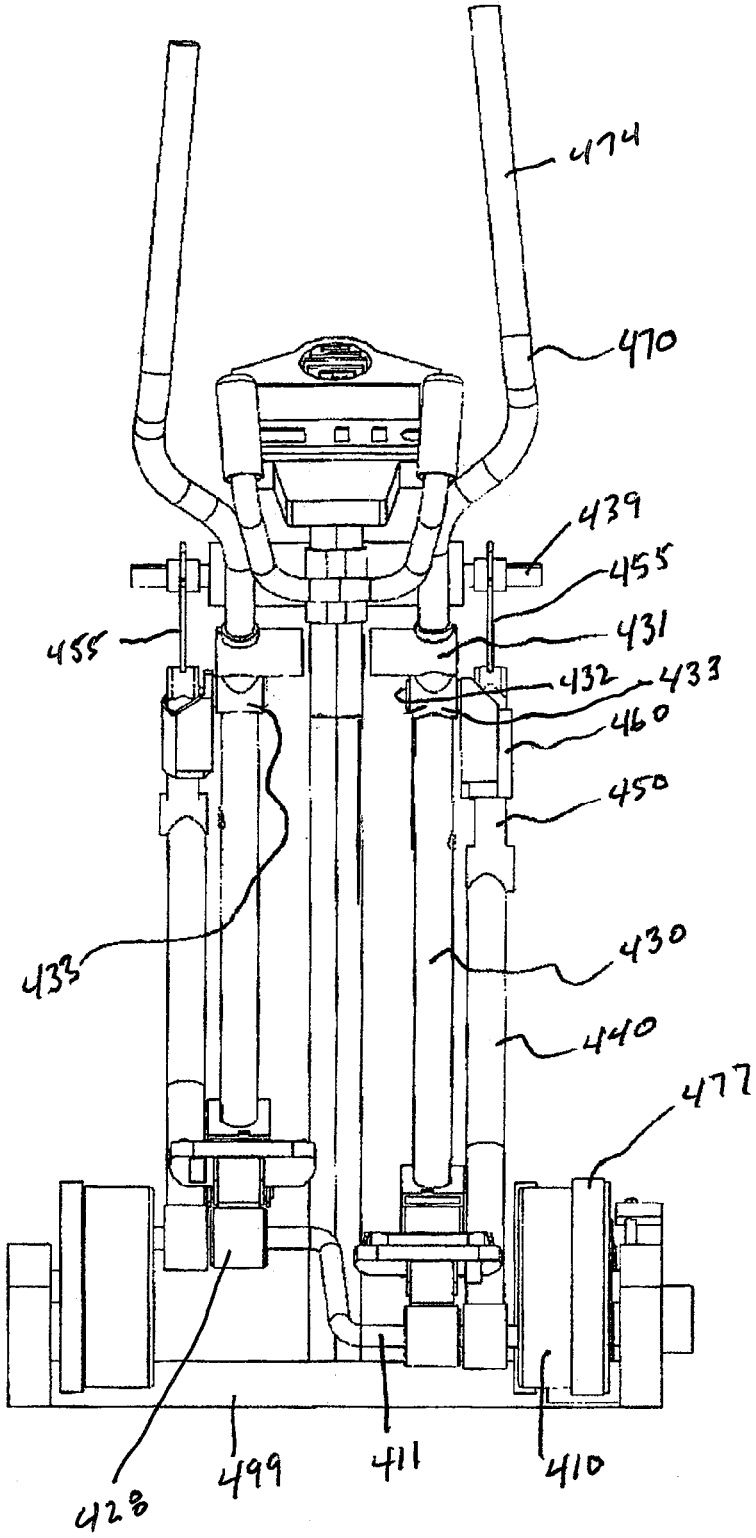
FIG. 10 is a rear view of the exercise apparatus of FIG. 5.
Figure 11:
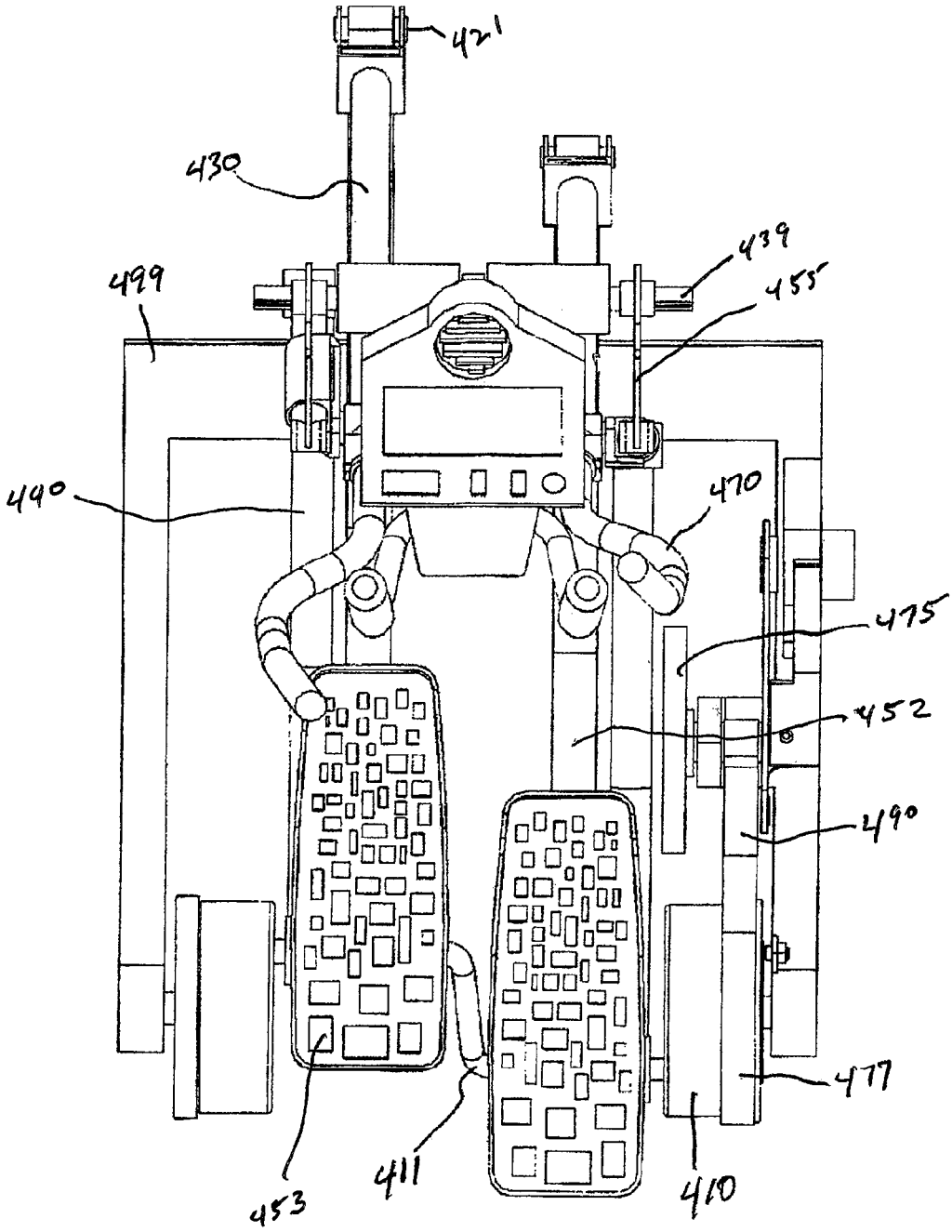
FIG. 11 is a top plan view of the exercise apparatus of FIG. 5.

A crank position sensor 412 is secured to the machine frame 499 and a crank shaft trigger disk 416 is affixed to the crank disk 410, as best shown in FIGS. 7 and 8. Crank rotational position is scanned by the position sensor 412 (pick-up sensor) and the data is transmitted to a control console 493 mounted on the stanchion 498. Sampling instants may be used for the determination of the orientation of the crank disk 410. Sensing devices used for the crank position sensor may be based upon inductive, capacitive or optic measuring principles. For example, the trigger disk 416 may include a plurality of holes, lines, dots or the like. A width or space may be defined between holes 414 and 417 (for example, two holes missing) serves for detection of the absolute angle position of the crank shaft. A missing hole, such as at point 418, may serve as an indicator for determining the direction of rotation of the crank disk 410.

Continuing now, in order to provide automatic responsive stride length and arm range motion (and/or flywheel brake resistance), a proportional signal of a segment of the flywheel belt 477 tension data is also transmitted to the control console 493 to be processed. As shown, flywheel belt idle pulley 490 is rotatably secured to an idler bracket 484. The idler bracket 484 is rotatably secured to the machine frame 499 at bearing 482. Sensing devices used to determine flywheel belt tension may be based upon inductive, capacitive or optic measuring principles, or alternatively determination of the frequency and characterizing the belt tension by means of sound or light may be implemented. Furthermore, belt tension determination using a hubload transducer and a torque transducer may be implemented. An idler pressure sensor 480 is interposed between a fixed frame stud 486 and an idler bracket boss 487. The idler bracket boss 487 is securely fixed on the idler bracket 484. Typically, when a user is exerting exerts greater force at the foot platform 453 or the handle bar 470, the slack side pressure sensed at idler pressure sensor 480 decreases, and when the user exerts less force at the foot platform 453 or the handle bar 470, the slack side pressure sensed at the idler pressure sensor 480 increases. When processing the sensory data of a known rotational position of the crank disk 410 and a known tension of the flywheel belt 477 proximate the idle pulley 490, the resultant signal comparison at multiple rotational positions of the crank disk 410 provides meaningful data to interpret the intent of the user weather to increase or decrease the stride length and arm range of motion and/or increase or decrease the brake resistance at the flywheel 475, subject to desired parameters.

Figure 12:
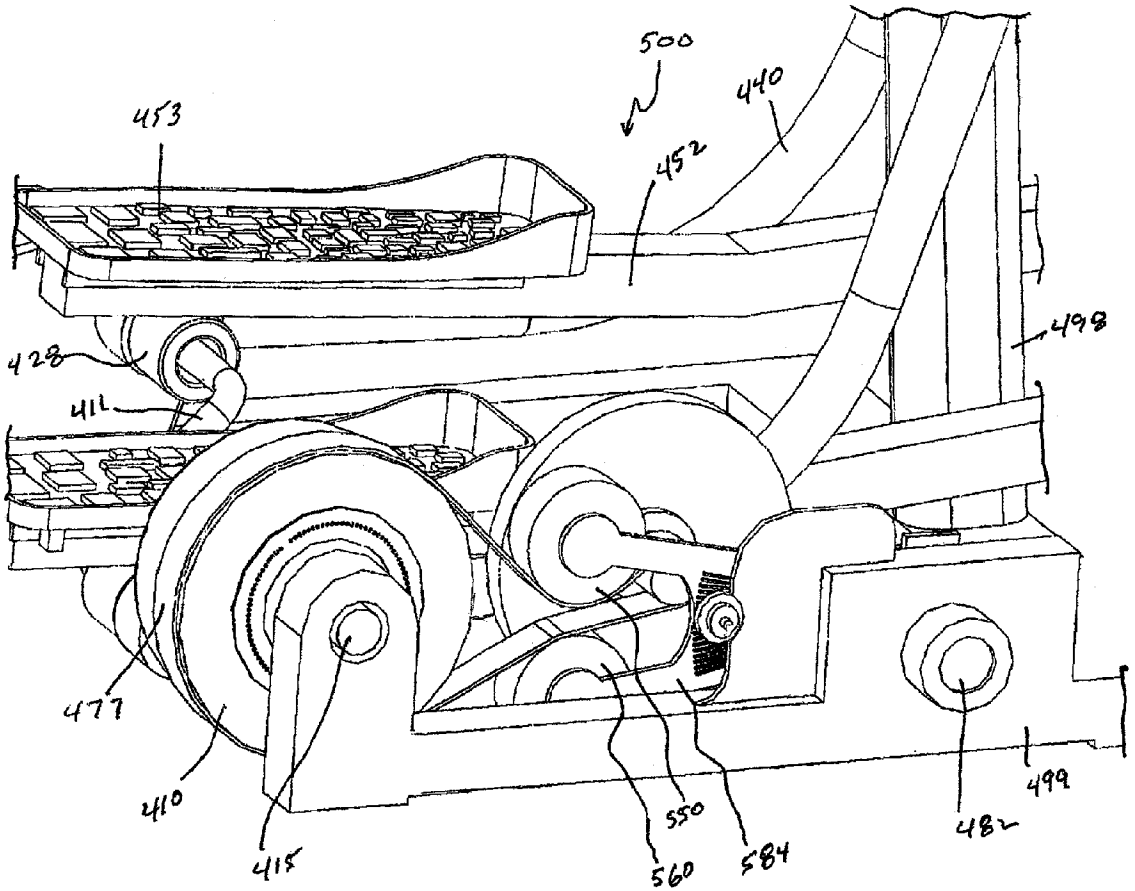
FIG. 12 is a fragmentary perspective of a fifth embodiment of an exercise apparatus of the invention.

Directing attention now to FIG. 12, a fifth embodiment generally identified by the reference numeral 500 is shown. A flywheel belt slack side idler 550 and a taut side idler 560 are rotatably secured to the idler bracket 584. It will be noted that in both the fourth and fifth embodiments shown, the slack/taut side of the flywheel belt relationship changes depending upon the desired rotational direction of the crank (i.e. forward/reverse). The sensor used in this instance may be similar to the sensor used to determine the crank orientation described above, but it is the change in orientation of the idler bracket 584 that is determined and transmitted for processing.

The reader will note that alternative embodiments which rely solely on mechanical means (non electric) to effect stride length, the actuator 472 may be replaced with a spring, a damper, and/or combination therewith, which allows the user to mechanically effect stride length as a function of the reaction forces present between drawbar rocker 450 and sleeve coupler 460, wherein such reaction forces cause more or less telescopic displacement relative thereto. As drawbar rocker 450 telescopes and moves relative to sleeve coupler 460, a forward distal end of the drawbar 440 raises or lowers, thereby proportionally changing the degree to which the handle bar rocker 430 reciprocates, and thereby causing the stride length to vary as a function of user applied force.

While preferred embodiments of the invention have been shown and described, other and further embodiments of the invention may be devised without departing from the basic scope thereof, and the scope thereof is determined by the claims which follow.

The invention claimed is:

1. A variable motion exercise apparatus, comprising:

a) a frame designed to rest upon a floor surface;

b) a left crank and a right crank, wherein each said crank is mounted on a respective side of said frame and rotatable about a common crank axis;

c) a left rocker link and a right rocker link, wherein each said rocker link is mounted on a respective side of said frame and rotatable about a common pivot axis;

d) a left foot support member and a right foot support member, wherein a forward distal end of each said foot support member is pivotally connected to a respective rocker link and a rearward portion of each said foot support member is in rolling contact with a roller rotatably mounted on each said crank;

e) a left drawbar linkage and a right drawbar linkage, wherein said drawbar linkage is movably connected between a respective rocker link and a respective crank in such a manner that a foot supporting portion of each said foot support member is constrained to move through a generally elliptical path as a respective crank rotates;

f) an actuator operatively connected to each said drawbar linkage;

g) sensor means for generating an output signal responsive to user applied force to each said rocker link and/or each said foot support member; and h) a control console that receives the output signal and transmits a control signal to said actuator to adjust the position of each said drawbar linkage relative to a respective rocker link to alter a respective path.

2. The exercise apparatus of claim 1, wherein each said drawbar linkage includes a drawbar and a drawbar rocker pivotally connected to one another, and wherein an end of said drawbar is rotatably connected to a respective crank and an end of said drawbar rocker is operatively connected to said actuator.

3. The exercise apparatus of claim 2, including a lever arm pivotally connected to an upper distal end of said drawbar rocker and wherein said lever arm is operatively connected to said actuator.

4. The exercise apparatus of claim 3, wherein said sensor means includes one or more sensors that generate an output signal responsive to user applied force to each said rocker link and/or each said foot support member.

5. The exercise apparatus of claim 1, wherein said sensor means includes a crank position sensor and an idler pressure sensor.

6. The exercise apparatus of claim 5 including a trigger disk fixedly secured to said crank.

7. The exercise apparatus of claim 6 wherein said trigger disk includes indicia measured by said crank position sensor for detecting the angular position of said crank.

* * * * *